US007931076B2

(12) United States Patent
Ditta et al.

(10) Patent No.: US 7,931,076 B2
(45) Date of Patent: Apr. 26, 2011

(54) SMALL FOOTPRINT DRILLING RIG

(75) Inventors: Joseph William Ditta, Pearland, TX (US); Reynaldo A. Gonzalez, Channelview, TX (US); Robert Gary Reider, Pearland, TX (US)

(73) Assignee: Process Manufacturing Corp., Houston, TX (US)

( * ) Notice: Subject to any disclaimer, the term of this patent is extended or adjusted under 35 U.S.C. 154(b) by 99 days.

(21) Appl. No.: 12/363,589

(22) Filed: Jan. 30, 2009

(65) Prior Publication Data

US 2009/0188677 A1 Jul. 30, 2009

Related U.S. Application Data

(60) Provisional application No. 61/024,739, filed on Jan. 30, 2008.

(51) Int. Cl.
*E21B 19/00* (2006.01)
*E21B 7/02* (2006.01)

(52) U.S. Cl. ..... 166/75.11; 166/85.1

(58) Field of Classification Search ..... 166/75.11, 166/85.1, 75.14
See application file for complete search history.

(56) References Cited

U.S. PATENT DOCUMENTS

| | | | | |
|---|---|---|---|---|
| 2,818,567 | A * | 1/1958 | Oliver | 227/40 |
| 4,024,924 | A | 5/1977 | Houck | |
| 4,489,526 | A * | 12/1984 | Cummins | 52/125.6 |
| 4,569,168 | A | 2/1986 | McGovney et al. | |
| 6,581,698 | B1 | 6/2003 | Dirks | |
| 6,634,436 | B1 | 10/2003 | Desai | |
| 6,974,123 | B2 | 12/2005 | Latvys | |
| 7,234,896 | B2 | 6/2007 | Donnally et al. | |
| 7,306,055 | B2 | 12/2007 | Barnes | |
| 7,357,616 | B2 | 4/2008 | Andrews et al. | |
| 2003/0051915 | A1 | 3/2003 | Brittain | |
| 2007/0107900 | A1 * | 5/2007 | Dreelan | 166/300 |
| 2010/0104401 | A1 * | 4/2010 | Hopkins et al. | 414/22.54 |

FOREIGN PATENT DOCUMENTS

EP 0312286 A2 4/1989

OTHER PUBLICATIONS

International Search Report and Written Opinion of the International Searching Authority mailed Sep. 11, 2009 in PCT/US2009/032722.

* cited by examiner

*Primary Examiner* — Kenneth Thompson
(74) *Attorney, Agent, or Firm* — Patterson & Sheridan, LLP

(57) ABSTRACT

A method and apparatus for a moving a floor structure relative to a base structure is provided. The apparatus includes a base structure having an opening for a well head, a floor structure coupled to the base structure by a plurality of support members, and a drive mechanism disposed on the floor structure, the drive mechanism providing motive force to the support members for moving the floor structure relative to the base structure in a single first direction.

16 Claims, 8 Drawing Sheets

SMALL FOOTPRINT DRILLING RIG

CROSS-REFERENCE TO RELATED APPLICATIONS

This application claims benefit of U.S. Provisional Patent Application Ser. No. 61/024,739, filed Jan. 30, 2008, which is incorporated herein by reference.

BACKGROUND

1. Field

Embodiments described herein relate generally to a lifting device having a floor movable relative to a base structure. More specifically, embodiments described herein relate to a drilling rig floor vertically movable relative to a base structure.

2. Description of the Related Art

Conventional drilling rigs, such as land based drilling rigs, typically include a mast structure supported by a substructure having a base and a drilling floor. When the drilling rig is set-up on a location, the drilling floor typically needs to be spaced away from the base structure, for example raised relative to the base structure to provide space for equipment, such as valves, fittings, blowout preventers, and other necessary equipment, between the base structure and the drilling floor.

In some conventional drilling rigs, the drilling floor is coupled and raised relative to the base structure in a general pivoting or cantilevered fashion such that the drilling floor is raised in an arc relative to the base. Raising the drilling floor relative to the base structure in this manner requires sequential lifting steps as lift devices, such as hydraulic cylinders, are coupled and decoupled repeatedly to the drilling floor to gain an enhanced mechanical advantage and/or to remain within the working range of the hydraulic cylinder. As such, numerous workers are required to be in the area between the drilling floor and base structure during erection, which poses a safety issue. This method also takes considerable time, requires substantial land area for set-up and lifting (or lowering), requires permitted hauls to and from the site, and requires a substantial amount of hydraulic equipment for operation.

Solutions to the challenges of safety and reducing the drilling rig footprint, physically and environmentally, have been attempted but have not proven to be workable or commercially desirable. Thus, there remains a need for a drilling rig having a movable drill floor that occupies a smaller footprint during raising or lowering, requires less time and personnel for operation, and minimizes the use of hydraulic equipment.

SUMMARY

Embodiments described herein generally provide an apparatus comprising a base structure and a floor structure movable relative to the base structure, the floor structure being movable in a single linear direction relative to the base structure.

In one embodiment, a substructure for a drilling apparatus is described. The substructure includes a base structure having an opening for a well head, a floor structure coupled to the base structure by a plurality of support members, and a drive mechanism disposed on the floor structure, the drive mechanism providing motive force to the support members for moving the floor structure relative to the base structure in a single first direction.

In another embodiment, a substructure for a drilling apparatus is described. The substructure includes a base structure having an opening for a well head, a floor structure coupled to the base structure by a plurality of support members, a drive mechanism disposed on the floor structure, the drive mechanism providing motive force to the support members for moving the floor structure relative to the base structure in a single first direction, and a safety mechanism allowing movement of the floor structure in the first direction while preventing movement in a second direction, the second direction being substantially normal to the first direction.

In another embodiment, a method for lifting a floor structure from a base structure is described. The method includes providing a drive mechanism disposed on the base structure, the drive mechanism disposed in a parallel orientation with the base structure, and actuating the drive mechanism to move the floor structure relative to the base structure in a first linear direction while maintaining a substantially parallel orientation between the floor structure and the base structure.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments described herein generally provide a drilling rig for use in land drilling operations having a substructure comprising base structure and a raisable drilling floor that occupies a smaller footprint and minimizes personnel during operation. Additionally, embodiments of the drilling floor and base structure described herein shorten the lifting time as compared to conventional drilling rigs, have a lessened environmental impact by minimizing hydraulic actuators, and are more cost efficient. While the embodiments described herein are exemplarily described for use with a drilling rig, some embodiments may be used for other applications requiring a floor structure to be raised or lowered relative to a base structure. Other applications include offshore platforms, work over rigs, or other application that may include lifting and lowering a floor structure relative to a base structure.

Various components described herein may be capable of independent movement in horizontal and vertical planes. Vertical is defined as movement orthogonal to a horizontal plane and will be referred to as the Z direction. Horizontal is defined as movement orthogonal to a vertical plane and will be referred to as the X or Y direction, the X direction being movement orthogonal to the Y direction, and vice-versa. The X, Y, and Z directions will be further defined with directional insets included as needed in the Figures to aid the reader.

Figure 1:
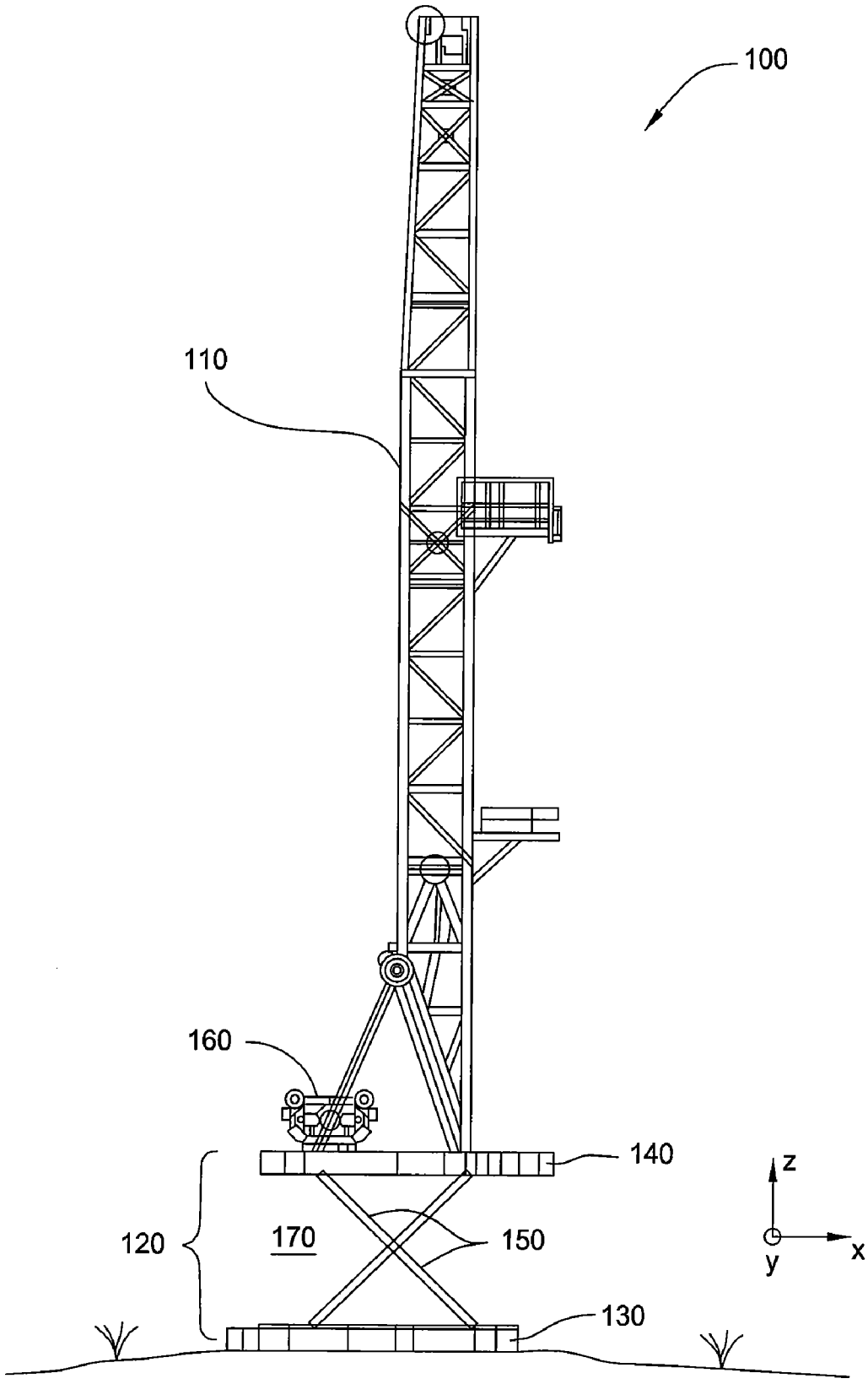
FIG. 1 is a front elevation view of a drilling rig having one embodiment of a substructure.
Figure 2:
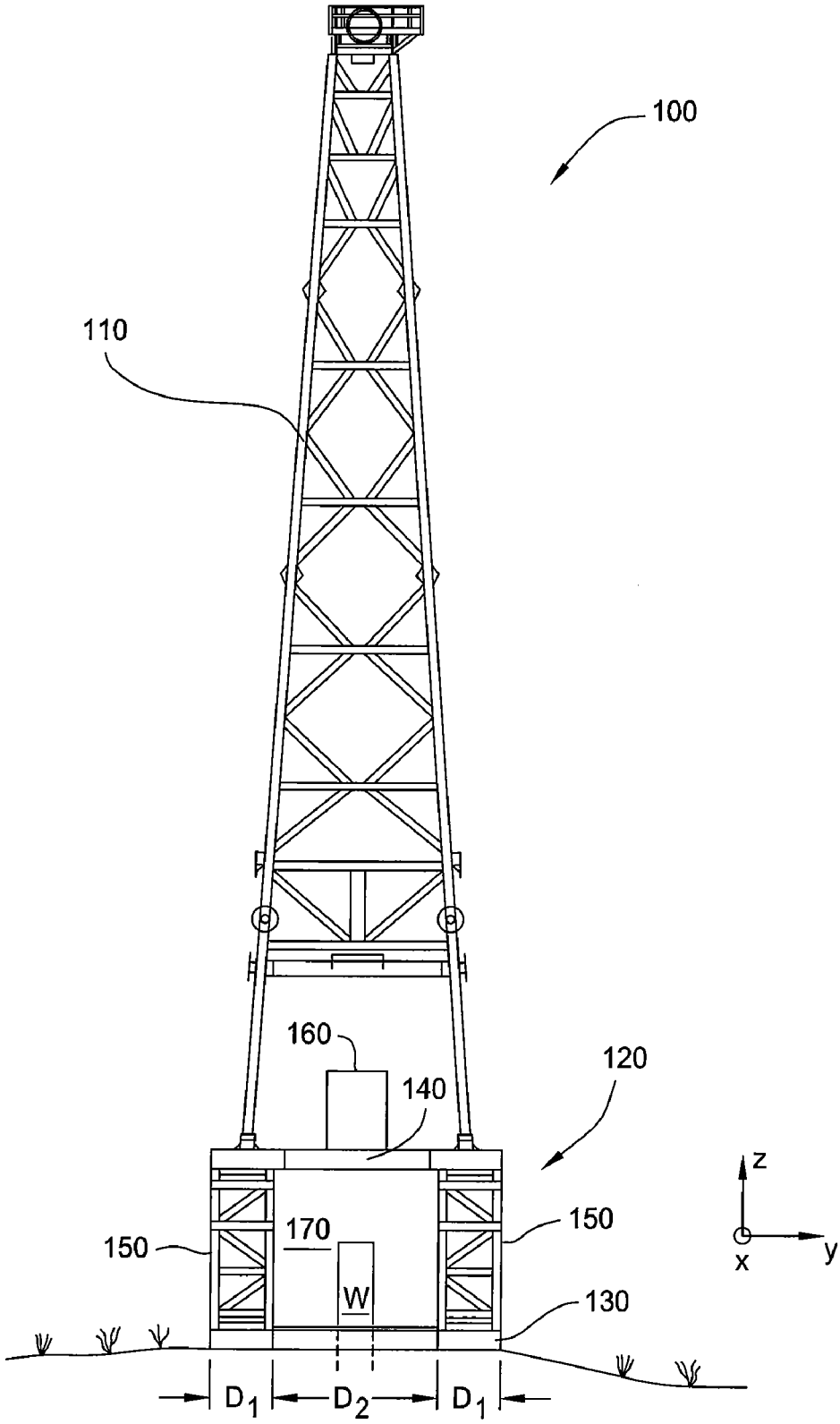
FIG. 2 is side elevation view of the drilling rig shown in FIG. 1.

FIGS. 1 and 2 are front and side elevation views of one embodiment of a drilling rig 100 for drilling or servicing a well head (generally indicated at W in FIG. 2). The drilling rig 100 includes a mast structure 110 coupled to a substructure 120 disposed on the ground. The substructure 120 includes a base structure 130 and a floor structure 140 supported by one or more support structures 150. The floor structure 140 functions as a platform for supporting equipment, such as a draw works 160, and as a drilling floor for use by personnel on the rig 100 to perform a drilling or servicing operation. The floor structure 140 also supports the mast structure 110 which, in turn, is supported by the base structure 130 disposed on the ground.

In operation of the rig 100, the floor structure 140 is spaced away from the base structure 130 to provide an area 170 therebetween that may be used to access the wellhead W. The area 170 may be used to store equipment, such as pumps, compressors, generators, motors and other support equipment (not shown), as well as providing ample room for access to the wellhead W for installation, removal, servicing, and inspection of valves, blowout preventers and other equipment (not shown) disposed in or near the wellhead W. It is desirable that the area 170 includes minimal obstructions and provides a safe environment for personnel to work. In this regard, support structures 150 are minimal in number and size and are amply spaced apart to provide access to personnel and equipment, while complying with all applicable engineering and safety codes. In the embodiment shown in FIGS. 1 and 2, the substructure 120 includes a pair of support structures 150. As an example of size, each support structure may include a dimension $D_1$ (shown in FIG. 2) that is between about 3 feet to about 12 feet and providing a dimension $D_2$ therebetween of about 10 feet to about 25 feet, dependent on the size of the base structure 130 and/or the floor structure 140.

Figure 3A:
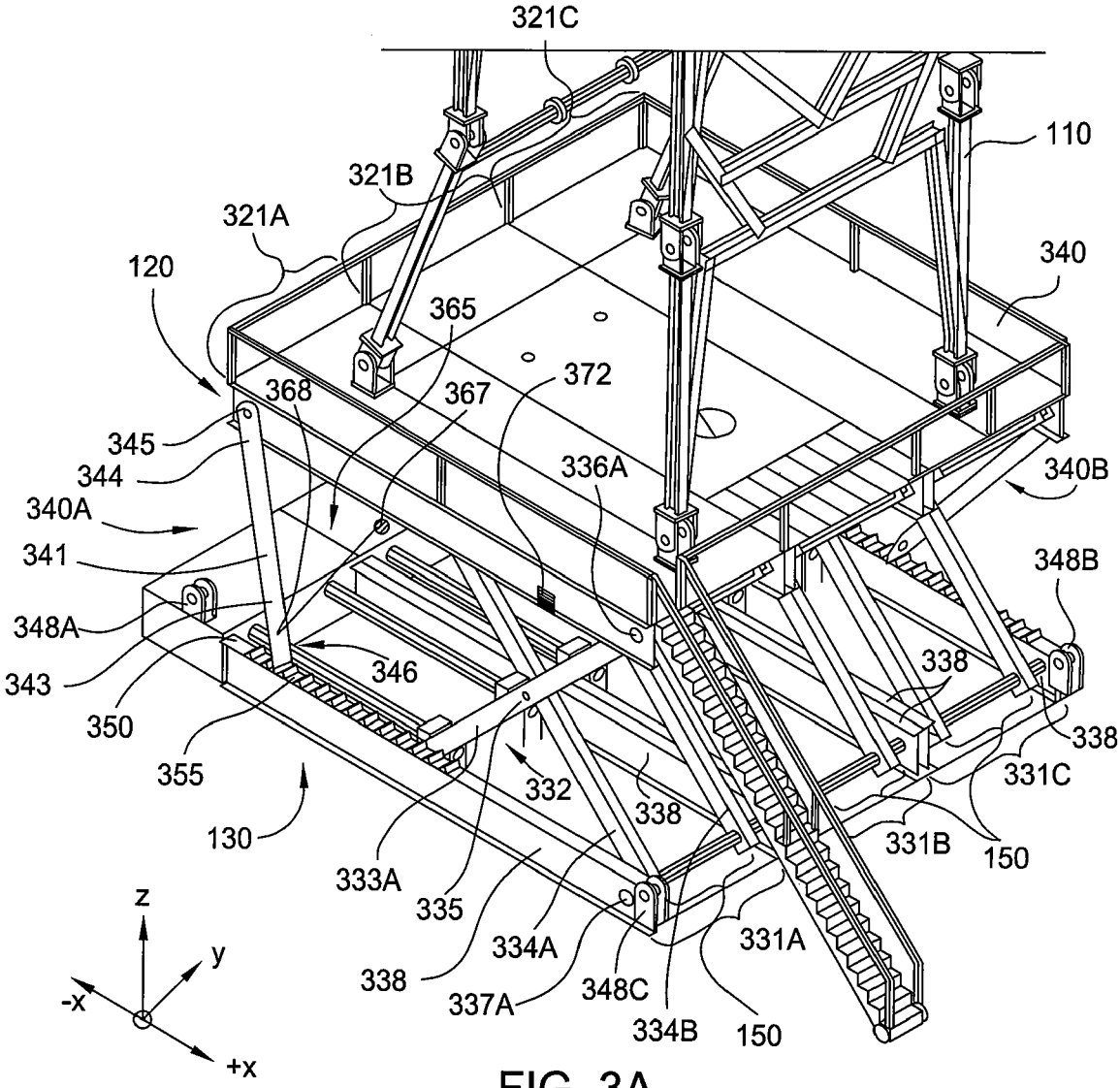
FIG. 3A is an isometric view of another embodiment of a substructure.

FIG. 3A is an isometric view of another embodiment of a substructure 120 having a mast structure 110 (only a portion is shown), a floor structure 140, and a base structure 130. The base structure 130 includes a plurality of structural members 338 that are coupled together in a substantially rectangular configuration to provide a stable support for the floor structure 140. In this embodiment, the substructure 120 is modular. The floor structure 140 and base structure 130 include multiple sections bounded by structural members 338 that may be manufactured and transported as discreet pieces and coupled together on-site. In this example, the floor structure 140 includes three floor sections 321A, 321B and 321C, and the base structure 130 includes three base sections 331A, 331B and 331C.

Prior to operation of the drill rig 100, as shown in FIGS. 1 and 2, the floor structure 140 must be spaced apart from the base structure 130 to provide space between the floor structure 140 and base structure 130. In this embodiment, the floor structure 140 is shown in a partially raised position such that the floor structure 140 is moved relative to the base structure 130 in a vertical (Z direction).

At least one of the base sections 331A, 331B and 331C includes a drive mechanism 332 (only one is shown in base section 331A). Each drive mechanism 332 is coupled to a support structure 150. Each support structure 150 includes a plurality of support arms 333 that are pivotally coupled to the floor structure 140 (only 333A is shown in this view) at a pivot point 336A and a plurality of support arms 334 that are pivotally coupled to the base structure 130 (only 334A and 334B are shown in this view) at a pivot point 337A. Each support arm 333, 334 is pivotally coupled together at pivot point 335. Each of the pivot points 336A, 337A and 335 may include a pin or a portion of a shaft that couples the support arms 333, 334 to a corresponding structure or each other. Each of the support members 333, 334 are adapted to move relative to each other to space the base structure 130 and floor structure 140 apart in a scissor-like movement. In one embodiment, the movement provided by the support arms 333 and 334 moves the floor structure 140 away from the base structure 130 in a substantially linear manner. In another embodiment, the movement provided by the support arms 333 and 334 move the floor structure 140 away from the base structure 130 such that the floor structure 140 remains substantially parallel with the base structure 130.

Additionally, the substructure 120 includes at least one safety mechanism adapted to prevent or minimize the possibility of collapse of the substructure 120 during relative movement of the floor structure 140 relative to the base structure 130. In this embodiment, the safety mechanism is shown as 340A and 340B. The safety mechanisms 340A, 340B are adapted as support members that are movably disposed between the base structure 130 and floor structure 140 during relative movement of the substructure 120. The safety mechanisms 340A and 340B are adapted to allow movement in a first direction (−X direction) while preventing movement in an opposing second direction (+X direction). The safety mechanism 340A is more clearly shown in this view and for ease of description, the description of safety mechanism 340B is omitted, although the construction and operation is substantially similar.

In this embodiment, the safety mechanism 340A comprises a support arm 341 having a first end 344 coupled to the floor structure 140 at a pivot point 345. The pivot point 345 may include a lug or bracket and/or a bolt or pin that allows free movement of the support arm 341 in at least a horizontal (X axis) and vertical (Z axis) direction. An opposing end of the support arm 341 includes a second or free end 343 adapted to move along an upper surface 350 of the base structure 130 as the floor structure 140 is lifted. The upper surface 350 includes a serrated member 355 that may be a saw-tooth gear or a linear rack gear, a plurality of grooves, notches or holes having a pitch and/or design adapted to releasably couple to the free end of the support arm 341. The serrated member 355 may be configured to allow movement of the support arm 341 in one direction only, which in this example is the X direction. Once the floor structure 140 is lifted to a specified height, the free end 343 of the support arm 341 may be coupled to a lug or bracket 348A, 348B to provide additional support to the floor structure 140.

While the embodiment shown in FIG. 3A includes one support structure 150 per section, one or more of the support structures 150 may be disassembled and removed from the substructure 120 after lifting if desired. Support arms, such as support arms 341 may be coupled between the base structure 130 and the floor structure 140 after lifting to provide support for the substructure 120. In one embodiment, all of the support structures 150 may be removed after lifting to provide additional space between the base structure 130 and the floor structure 140.

Figure 3B:
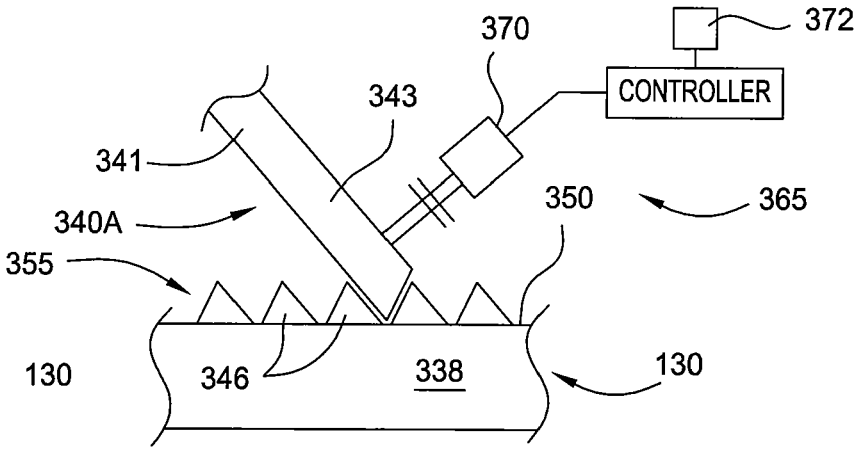
FIG. 3B is a side view of a portion of the structural member and the safety mechanism shown in FIG. 3A.

FIG. 3B shows a side view of a portion of the structural member 338 and the safety mechanism 340A shown in FIG. 3A. In an operational example, when the floor structure 140 is raised, the support arm 341 is adapted to operate in a ratchet or pawl action such that the free end 343 slides across the face and/or top land of each gear tooth 346 and sequentially fall across an opposing face of each gear tooth. In the case of a failure of the drive mechanism 332, the free end 343 is stopped by a bottom land and/or face of one of the gear teeth. Thus, if any portion of the drive mechanism 332 fails during lifting, the free end 343 of the support arm 341 catches the serrated device 355 to temporarily provide support for the floor structure 140 and prevent the floor from falling.

In an operation where the floor structure 140 is lowered, the free end 343 of the support arm 341 may be raised clear of the serrated member 355 such that the free end does not engage the teeth 346. This allows the free end 343 to move in the +X direction during lowering of the floor structure 140. The free end 343 may be elevated relative to the serrated member 355 in numerous ways. In one embodiment (not shown), the free end 343 of the support arm 341 is coupled to an elevating mechanism comprising a cable or rope and pulley system. One end of the cable or rope may be attached to the free end 343 and the free end of the cable or rope may be routed through a sheave or pulley system disposed on the substructure 120. The free end of the rope or cable may be coupled to a winch or other piece of machinery adapted to take up slack in the rope or cable as needed. The winch or machinery may also be adapted to quickly release the cable or rope, allowing the free end 343 to drop onto the serrated member 355 if the drive mechanism fails. Another example would include rig personnel holding the free end of the rope or cable at a safe distance from the substructure 120. The rig personnel should monitor the lowering of the floor structure 140 and release the free end of the rope or cable in the event of drive mechanism failure. This allows the free end 343 of the support arm 341 to re-engage the serrated member 355 and stop the motion of the floor structure 140.

In one embodiment, the safety mechanism 340A is coupled to an elevating device 365. The elevating device 365 includes an actuator 370 that may be a hydraulic, pneumatic, electrical or electromechanical actuator that is coupled to the free end 343 of the support arm 341 and another portion of the substructure 120, such as a bottom surface of the floor structure 140. The actuator 370 is in communication with a controller that may be programmed to keep the free end 343 clear of or engaged with the serrated member 355. In one embodiment, the controller is in communication with a sensor 372 adapted to sense the position and/or movement of the floor structure 140. In one embodiment, the sensor 372 is an accelerometer, a proximity sensor, or a combination thereof. The sensor 372 provides data to the controller which, in turn, controls the actuator 370. If a sudden acceleration and/or positional change is detected by the sensor 372, the controller sends a signal to the actuator 370 to move the free end 343 into re-engagement with the serrated member 355 to stop the motion of the floor structure 140.

In another embodiment, shown in FIG. 3A, an elevating device 365 includes a cable 368 coupled to the support arm 341 at one end. The other end of the cable 368 is coupled to a motorized sheave 367, which may be a rotating wheel, drum or winch adapted to elevate the free end 343 relative to the serrated member 355. The sheave 367 may be coupled to a controller calibrated to the rate of descent of the floor structure 140 such that the free end 343 is maintained to clear the serrated member 355. The controller may also be coupled to the sensor 372 to signal the sheave 367 to free-wheel in the event of a failure of the drive mechanism 332.

Figure 4A:
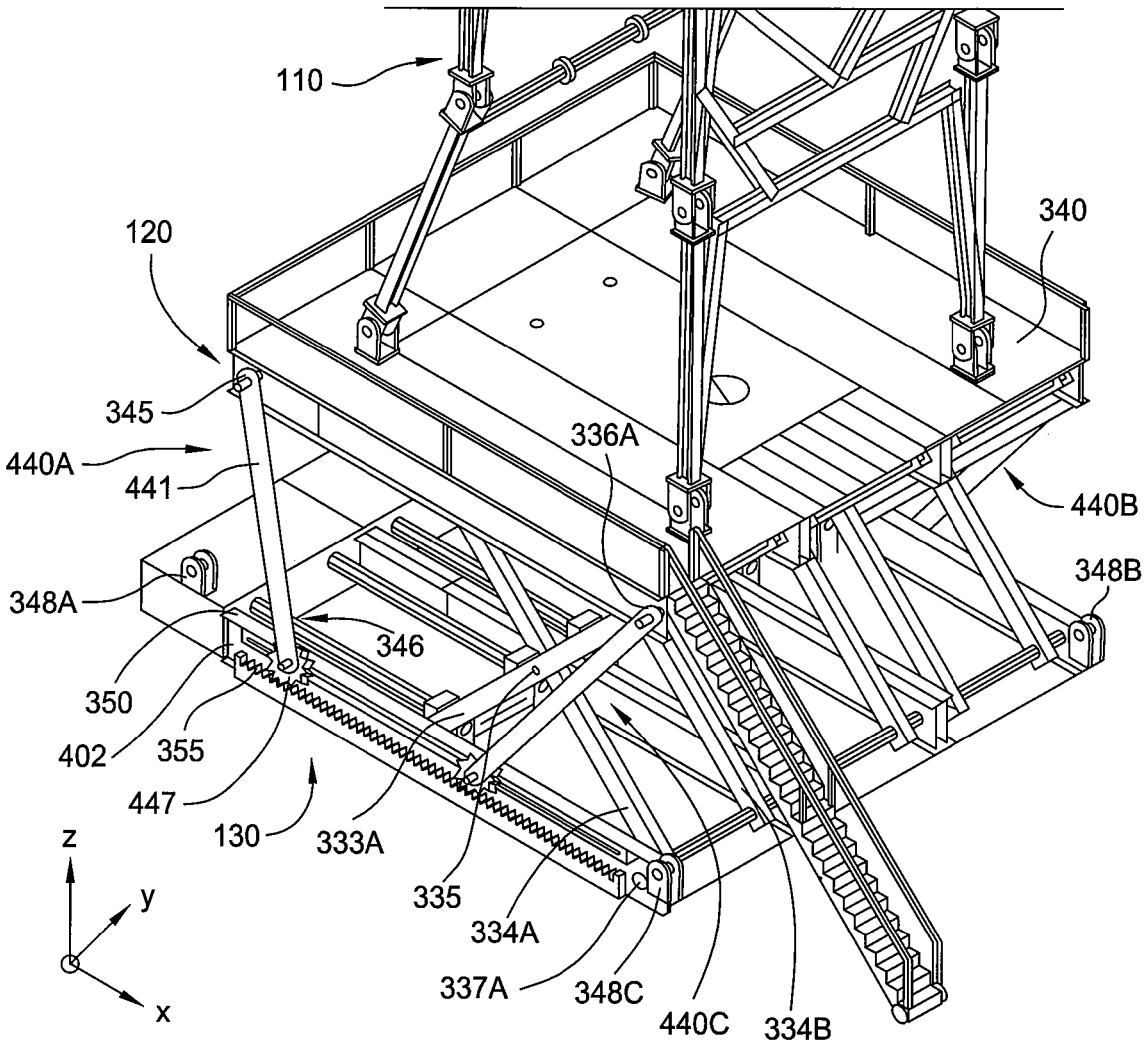
FIG. 4A is an isometric view of another embodiment of a substructure.

FIG. 4A is an isometric view of another embodiment of a substructure 120 showing an alternative embodiment of a safety mechanism. In this embodiment, the substructure 120 includes a safety mechanism at each corner shown as safety mechanisms 440A, 440B and 440C (the corner opposite safety mechanism 440C includes a safety mechanism 440D but is not shown in this view). The safety mechanisms 440A and 440C are more clearly shown in this view and for ease of description, the description of safety mechanisms 440B and 440D is omitted, although the construction and operation is substantially similar.

The safety mechanisms 440A, 440C comprise a support arm 441 having a first end 442 coupled to the floor structure 140 at a pivot point 445. The pivot point 445 may include a lug or bracket and/or a bolt or pin that allows free movement of the support arm 441 in at least a horizontal (X axis) and vertical (Z axis) direction. An opposing end of the support arm 441 includes a free end 443 adapted to move along an upper surface 350 of the base structure 130 as the floor structure 140 is lifted. The upper surface 350 includes a serrated member 455 that may be a saw-tooth gear or a linear rack gear having a pitch and design adapted to couple with a toothed wheel 447, such as a pinion gear. Rotation of the wheel 447 may be limited to a single direction, such as a clockwise or counter-clockwise direction, depending on whether the floor structure 140 is being raised or lowered. Once the floor structure 140 is lifted to a specified height, the wheel 447 may be removed and the free end 443 of the support arm 441 may be coupled to a lug or bracket 348A, 348C to provide additional support to the floor structure 140.

In this embodiment, the serrated member 355 is coupled to an outer surface 402 of the structural member 338 although other coupling locations may be used, such as an inside surface of the structural member 338 or the upper surface 350 of the structural member 338. The serrated member 355 is elongated in this embodiment such that the pair of safety mechanisms 440A and 440C share the serrated member 355. In one embodiment, the safety mechanisms 440A-440D are provided at or near each corner of the substructure 120 as shown. In another embodiment, other safety mechanisms similar to the safety mechanisms 440A-440D may be provided to portions of the substructure 120 between the support structures 150.

Figure 4B:
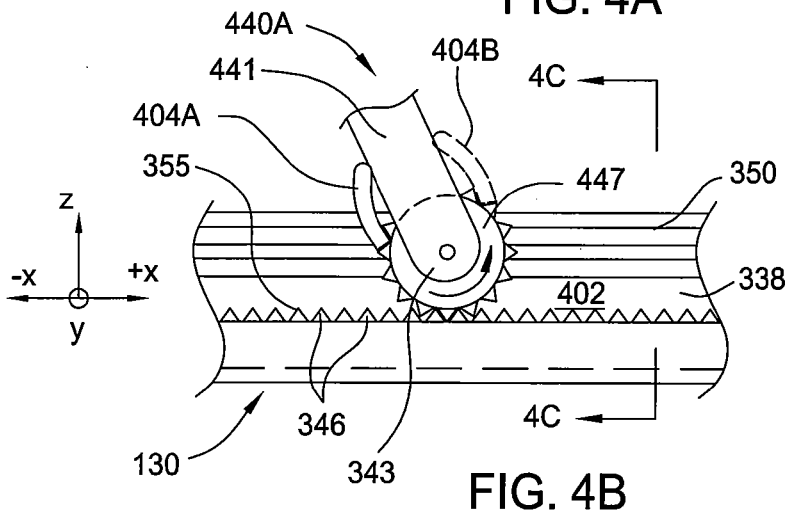
FIG. 4B shows a side view of a portion of the structural member and the safety mechanism shown in FIG. 4A.

FIG. 4B shows a side view of a portion of the structural member 338 and the safety mechanism 440A shown in FIG. 4A. In an operational example, when the floor structure 140 is raised, the wheel 447 moves counter-clockwise moving the free end 443 of the support arm 441 in the −X direction. A catch mechanism 404A, such as a pivoting bar or pawl, allows the counter-clockwise rotation of the wheel 447 while preventing clockwise rotation. In the case of a failure of the drive mechanism 332, the free end 343 is prevented from moving in the +X direction by action of the catch mechanism 404A and one of the gear teeth. Thus, if any portion of the drive mechanism 332 fails during lifting, the support arm 441 may provide temporary support for the floor structure 140. While not shown, the catch mechanism 404A may include a concave surface having one or more teeth adapted to substantially mate with one or more of the teeth on the wheel 447 in order to provide additional surface area and mechanical strength.

In an operational example where the floor structure 140 is to be lowered, the safety mechanism 440A may be used in a reverse manner by moving the catch mechanism 404A to an opposing side of the support arm 441 (shown in phantom as 404B). Thus, clockwise rotation of the wheel 447 may be permitted while counter-clockwise rotation is not. This allows the support arm 441 to move in the +X direction during lowering of the floor structure 140. If a drive mechanism fails during lowering, the support arm provides temporary support for the floor structure 140.

Figure 4C:
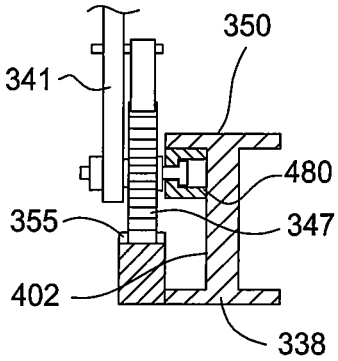
FIG. 4C is a cutaway view of FIG. 4B taken at line C-C.

FIG. 4C is a cutaway view of FIG. 4B taken at line 4C-4C. A track 480 is shown coupled to the structural member 338. The track 480 may include an enlarged channel adapted to receive an enlarged head of a pin or bolt coupling the wheel 447 to the support arm 441. The track 480 allows X directional movement while preventing Y directional movement of the support arm 441.

Figure 5A:
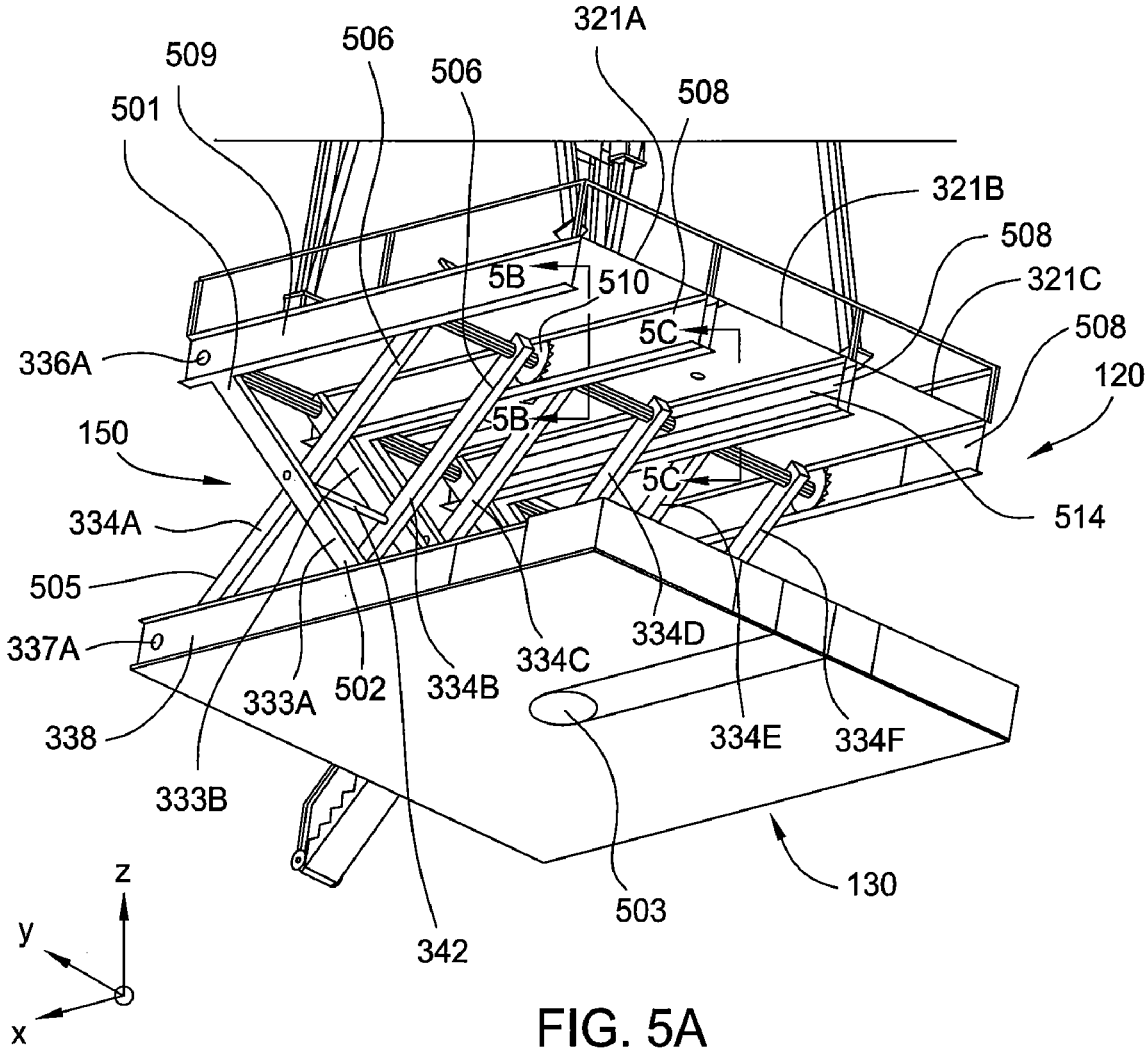
FIG. 5A is an isometric bottom view of the substructure shown in FIG. 3A.

FIG. 5A is an isometric bottom view of the substructure 120 shown in FIG. 3A. An opening 503 is formed through the base structure 130 that is sized for a wellbore and allow passage of tools and casing in forming or servicing the wellbore. Further describing the substructure 120 of FIG. 3A, each support structure 150 includes a plurality of support members 333 (only 333A and 333B are clearly shown) having a first end 501 hingedly or pivotally coupled to the floor structure 140 at pivot point 336A, which may include a pin or a portion of a shaft, and a second end 502 movably coupled to the base structure 130. Likewise, a plurality of support members 334A-334F include a first end 505 hingedly or pivotally coupled to the base structure 130 at pivot point 337A and a second end 506 movably coupled to the floor structure 140. The second end 506 of the support members 334A-334F are coupled to the floor structure 140 in a manner that provides movement of the second end 506 relative to the floor structure 140. In one embodiment, the second ends 506 are movably coupled to a structural member 509 that is part of the floor structure 140. Each support structure 150 also includes a central shaft 342 pivotally coupling the support members 333 and 334 together.

In one embodiment (shown in section 321A of the floor structure 140), relative movement between the second ends 506 of the support members 334A and 334B and the floor structure 140 is facilitated by rolling members 510. The rolling members 510 may be a wheel, a caster, or a gear that is coupled by a shaft 512 to the second ends 506 of the support members 334A-334F (only one end and rolling member is shown in this view). In another embodiment (shown in section 321B of the floor structure 140), relative movement between the second ends 506 of the support members 334A and 334B and the floor structure 140 is facilitated by a track 514.

Figure 5B:
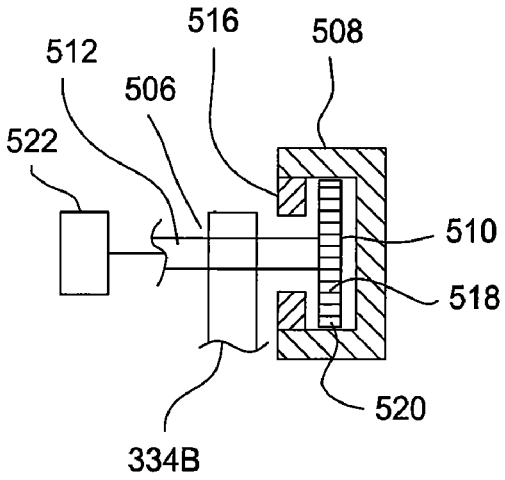
FIG. 5B is a cross-sectional view taken from line B-B of FIG. 5A.

FIG. 5B is a cross-sectional view taken from line B-B of FIG. 5A showing one embodiment of a rolling member 510 and structural member 508 interface. The structural member 508 may be an I-beam, an H-beam, a W-beam, a channel, a tubular member or other structural shape. A flange portion 516 may be utilized to form a partial enclosure for the rolling member 510. The rolling member 510 may be fixed to the shaft 512 or adapted to rotate relative to the shaft 512. In one embodiment, the shaft 512 is fixed to the rolling member 510 and is coupled through an opening in the second end 506 of the support member 334B in a manner that allows free rotation of the shaft 512 and rolling member 510.

The rolling member 510 is in contact with at least one surface of the structural member 508 during raising and lowering of the floor structure 140. In one embodiment, the rolling member 510 includes gear teeth 518 adapted to mesh with a rack gear 520 disposed on the structural member 508. In addition, a safety mechanism, such as a brake system 522 or shot pin, may be coupled to the shaft 512 or wheel member 510 to slow or stop rotation of the shaft 512 and rolling member 510 if needed. Thus, in the event of drive mechanism failure, the support structure 150 may be used to temporarily support the floor structure 140.

Figure 5C:
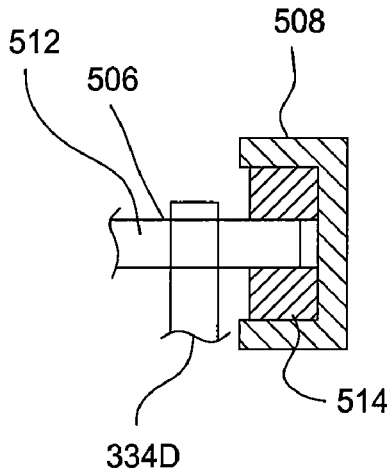
FIG. 5C is a cross-sectional view taken from line C-C of FIG. 5A.

FIG. 5C is a cross-sectional view taken from line C-C of FIG. 5A showing one embodiment of track 514. In this embodiment, the shaft 512 may be a rectangular or circular solid rod or a rectangular or circular tubular member adapted to be in contact with at least one surface of the track 514. The shaft 512 may rotate relative to the second end 506 of the support member 334D and/or the track 514, or the shaft 512 may be in sliding contact with the track 514.

Figure 6:
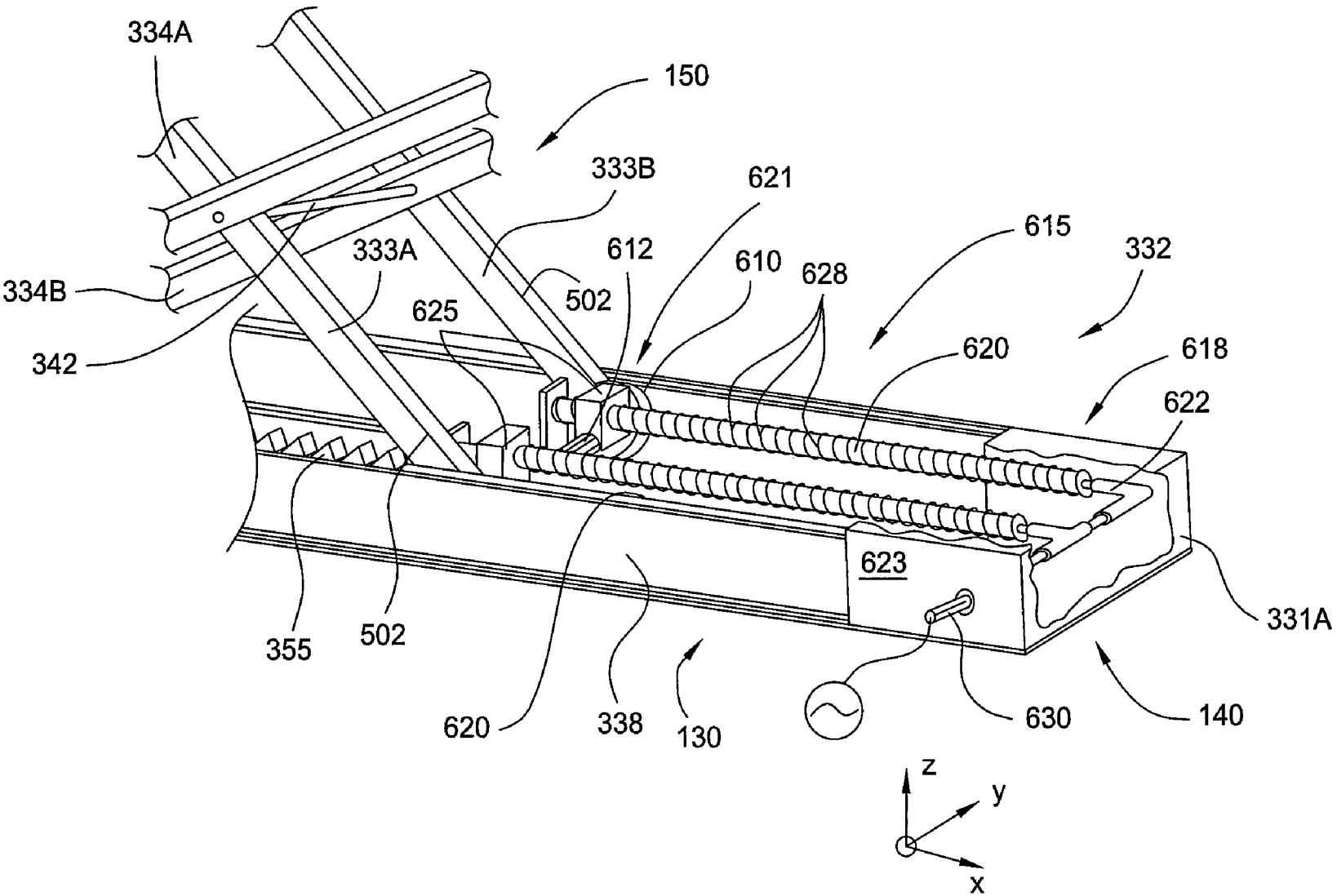
FIG. 6 is an isometric view of a portion of the floor structure of FIG. 3A.

FIG. 6 is an isometric view of a portion of the floor structure 140 of FIGS. 3A, 4A and 5A showing one embodiment of a drive mechanism 332. As described in FIG. 3A, the support structure 150 includes a plurality of support arms 333A, 333B having a second end 502 movably coupled to the floor structure 140. As the second end 502 of support arm 333B is more clearly shown in this view, the description of the second end 502 of support 333A is omitted, although the construction and operation is substantially similar.

In one embodiment, the second end 502 of the support arm 333B includes a rolling member 610 in contact with at least a portion of the structural member 338. The rolling member 610 is coupled to a shaft 612 that may be configured similarly to the shaft 512 described in FIG. 5A and the rolling member 610 may be substantially similar to the rolling member 510 described in FIG. 5A. While not shown, the rolling member 610 may interface with the structural member 338 as described in FIG. 5B. Alternatively, the structural member 338 may include a track (not shown) and the shaft 612 may interface with the track as described in FIG. 5C.

In one aspect, the drive mechanism 332 is disposed in a parallel relationship with the base structure and is adapted to provide motive force in a horizontal (X direction) to move the floor structure 140 relative to the base structure 130 in a vertical (Z direction). In one embodiment, the drive mechanism 332 includes a drive train 615 that includes at least a first transmission 618 and a second transmission 621 coupled to the shaft 612 by at least one drive shaft 620. Although the drive train 615 includes two drive shafts 620, only one drive shaft 620 may be used. The drive train 615 is configured to move the second ends 502 of the support arms 333A, 333B laterally (X direction) relative to the base structure 130. In one aspect, the first transmission 618 includes at least one gear device 622 coupled to each drive shaft 620. The gear device 622 may be a right-angle gear box, a face gear, or a worm gear. In this embodiment, two gear devices 622 are utilized (one gear device 622 per drive shaft 620) and are disposed in a housing 623.

The drive shafts 620 may be solid rods or tubular members including a plurality of grooves or threads 628. In one embodiment, each drive shaft 620 is a threaded rod, such as all thread or a portion of an ACME screw. Each drive shaft 620 is operably coupled to each gear device 622 by a suitable connection, such as a splines and/or a universal joint. The second transmission 621 includes a bearing block 625 that is coupled between the drive shaft 620 and the shaft 612 coupled to the second ends 502 of the support arms 333A, 333B. The bearing block 625 may be a threaded nut, a lead screw, or a gear device adapted to transmit torque from the drive shaft 620 to the shaft 612.

The at least one gear device 622 may be coupled to a power source, such as an engine, a motor, or other power source adapted to provide torque to the drive train 615. In one embodiment, the gear device includes a shaft 630 that is adapted to couple to the power source or coupled to other sections 331B, 331C (FIG. 3A).

Figure 7:
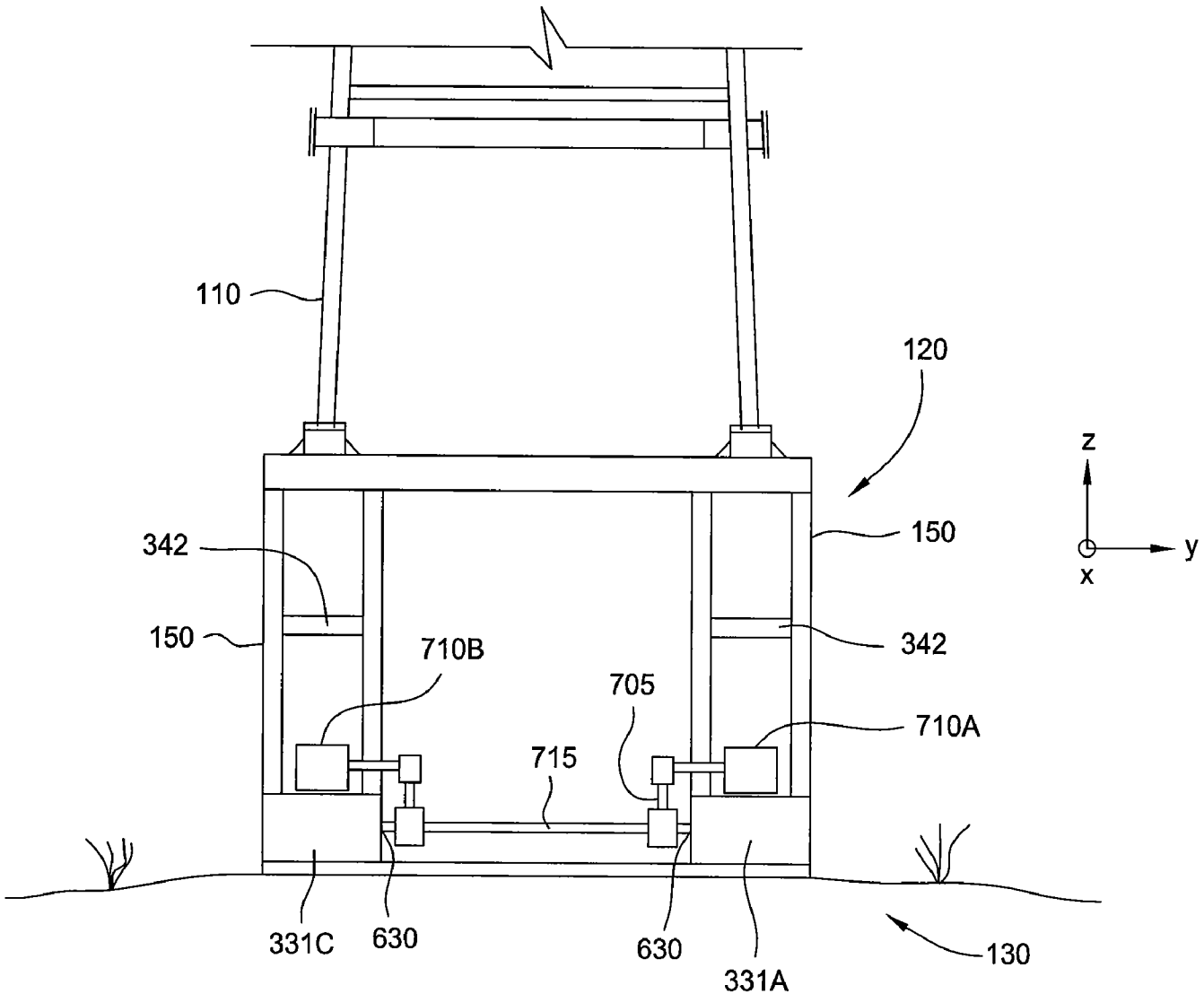
FIG. 7 shows another embodiment of a substructure.

FIG. 7 shows another embodiment of a substructure 120 with integral power sources disposed thereon for lifting or lowering the floor structure 140 relative to the base structure 130. In this embodiment, the base structure 130 includes two sections 331A, 331C and at least one power source 710A, 710B is coupled to each section 331A, 331C. Each power source 710A, 710B may be an electric motor that is coupled to the shaft 630 by a belt or chain 705. While not shown, the power sources 710A, 710B may be coupled to a gear reduction device, switches, and a speed controller.

While one power source 710A, 710B is shown per section 331A, 331C, only one power source 710A or 710B may be utilized on the substructure 120 to lift and lower the floor structure 140 relative to the base structure 130. In this embodiment, an elongated shaft 715 may be coupled to shafts 630 disposed on each section 331A, 331C. Thus, only one of the power sources 710A, 710B may be integrated and coupled to the substructure 120 to lift or lower the floor structure 140 relative to the base structure 130.

Figure 8:
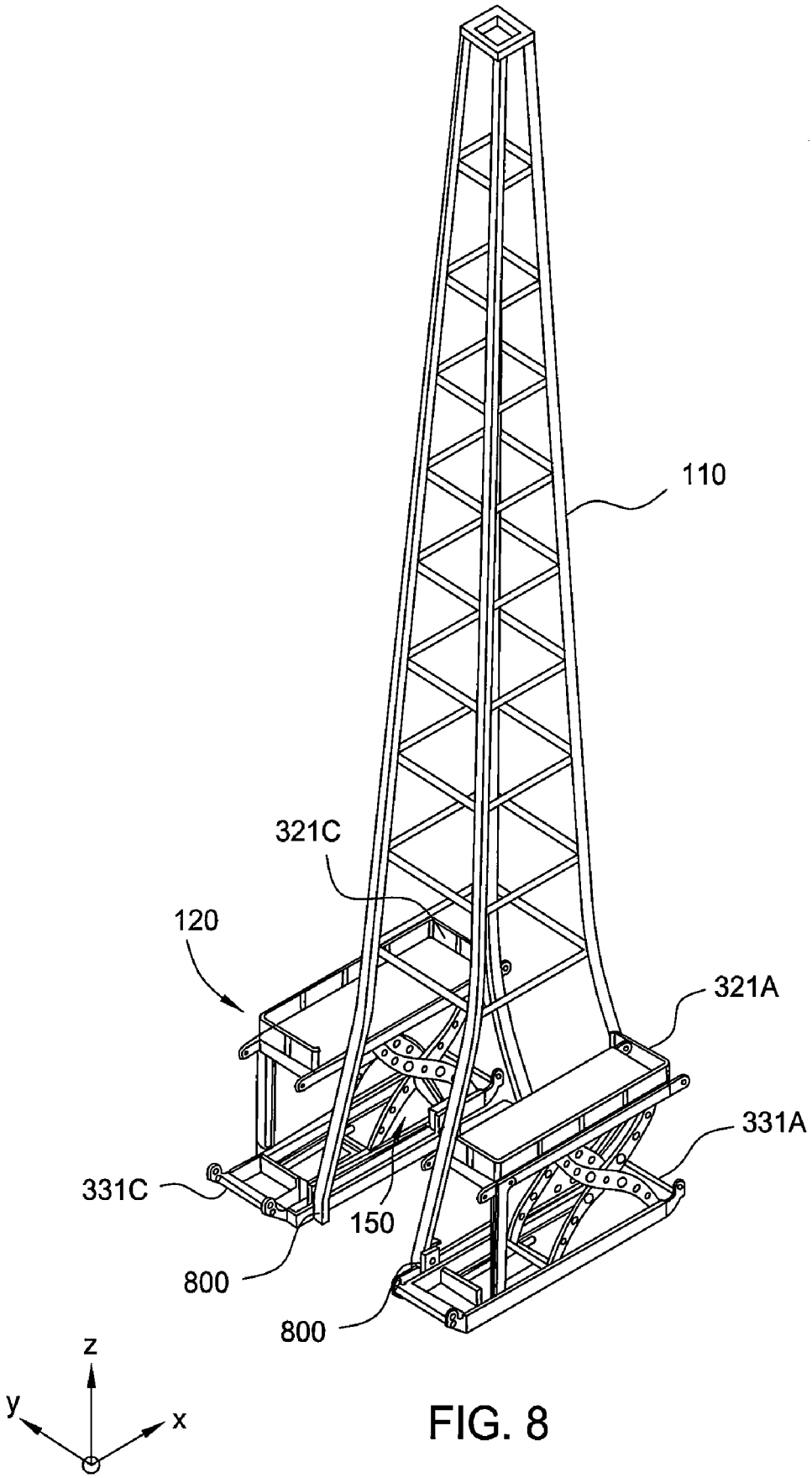
FIG. 8 is an isometric view of another embodiment of a substructure.

FIG. 8 is an isometric view of another embodiment of a substructure 120 that is in two sections 331A, 331C without a middle section such that a mast structure 110 may be sandwiched therebetween. In this embodiment, the mast structure 110 is shown coupled to the ground by support members 800 (only two are shown) between the two sections 331A, 331C. The area between the sections 321A and 321C is not shown for clarity and may be covered or provided with a floor (and railing).

The substructure 120 may be raised or lowered with or without the mast structure 110 thereon. In the embodiments shown in FIGS. 1-3A, the mast structure 110 may be pinned to the substructure 120 in a vertical orientation and the mast structure 110 may be raised in the vertical orientation. Alternatively, the mast structure 110 may be pinned on one end to the substructure 120 and after the floor structure 140 is raised, the mast structure 110 may be rotated to the vertical position and pinned to the substructure 120 at the other end. In the embodiment shown in FIG. 8, the mast structure 110 may be erected or placed directly over the well head and the sections 331A, 331C may be placed on either side thereof and raised. As mentioned above, flooring may be added to the sections 331A, 331C to cover the area between the sections 331A, 331C.

Embodiments described herein provide a smaller footprint for a drilling rig, which allows enhanced access of the drilling rig to smaller sites. Additionally, the smaller footprint of the drilling rig requires less vegetation to be removed prior to placement, which is more environmentally friendly. The drive mechanism 332 as described herein is faster and requires less operating personnel, which reduces costs and increases safety. Other advantages include minimization of hydraulic power, which decreases operating costs while minimizing environmental impact due to production and disposal of hundreds of gallons of hydraulic oil. Also, the substructure 120 as described herein is modular and may be hauled to the drill site using standard length trailers and/or minimal use of "oversize load" permits.

While the foregoing is directed to embodiments of the invention, other and further embodiments of the invention may be devised without departing from the basic scope thereof, and the scope thereof is determined by the claims that follow.

What is claimed is:

1. A substructure for a drilling apparatus, comprising:
- a base structure;
- a floor structure coupled to the base structure by a plurality of support members; and
- a power train disposed on the floor structure, the power train providing motive force to the support members for moving the floor structure relative to the base structure in a single first linear direction and maintaining the base structure and floor structure in a substantially parallel relationship, wherein the power train is positioned substantially normal to the first linear direction.

2. The apparatus of claim 1, wherein the drive mechanism comprises an actuator selected from the group consisting of an electrical motor or an internal combustion engine.

3. A substructure for a drilling apparatus, comprising:
- a base structure;
- a floor structure coupled to the base structure by a plurality of support members;
- a drive mechanism disposed on the floor structure, the drive mechanism providing motive force to the support members for moving the floor structure relative to the base structure in a single first linear direction and maintaining the base structure and floor structure in a substantially parallel relationship; and
- a safety mechanism allowing movement of the floor structure in the first linear direction while preventing movement in a second linear direction, the second linear direction being substantially opposite to the first direction.

4. The apparatus of claim 3, wherein the safety mechanism comprises a support arm having a first end coupled to the floor structure and a second end engaged with a toothed member fixed to the base structure.

5. The apparatus of claim 3, wherein the safety mechanism comprises a support arm having a first end coupled to the floor structure and a second end comprising a geared wheel.

6. The apparatus of claim 5, wherein the second end comprises a catch device for allowing movement of the second end in a third linear direction while preventing movement in a fourth linear direction, the third linear direction being substantially orthogonal to the first linear direction, and the fourth linear direction being opposite the third linear direction.

7. The apparatus of claim 5, further comprising a sensor device in communication with a controller and the safety mechanism.

8. A substructure for a drilling apparatus, the substructure comprising:
- a base structure having an opening for a well head;
- a floor structure coupled to the base structure by a plurality of support members;
- a drive mechanism disposed on the floor structure, the drive mechanism providing motive force to the support members for moving the floor structure relative to the base structure in a single first linear direction; and
- a safety mechanism allowing movement of the floor structure in the first linear direction while preventing movement of the floor structure in a second linear direction, the second linear direction being substantially opposite to the first linear direction.

9. The apparatus of claim 8, wherein the drive mechanism comprises a power train positioned substantially normal to the first direction.

10. The apparatus of claim 9, wherein the power train comprises an actuator selected from the group consisting of an electrical motor or an internal combustion engine.

11. The apparatus of claim 8, wherein the safety mechanism comprises a support arm having a first end coupled to the floor structure and a second end engaged with a toothed member fixed to the base structure.

12. The apparatus of claim 8, wherein the safety mechanism comprises a support arm having a first end coupled to the floor structure and a second end comprising a geared wheel.

13. The apparatus of claim 12, wherein the second end comprises a catch device for allowing movement of the second end in a third linear direction while preventing movement in a fourth linear direction, the third linear direction being substantially orthogonal to the first linear direction, and the fourth linear direction being opposite the third linear direction.

14. The apparatus of claim 12, further comprising a sensor device in communication with a controller and the safety mechanism.

15. The apparatus of claim 8, wherein the base structure and floor structure include at least two sections.

16. The apparatus of claim 15, wherein the at least two sections are spaced apart to provide a space therebetween for a mast structure.

* * * * *